United States Patent [19]

Uno et al.

[11] Patent Number: 4,790,746

[45] Date of Patent: Dec. 13, 1988

[54] VAPORIZING FUEL BURNER

[75] Inventors: Katsuhiko Uno; Katsuhiko Ishikawa; Shojiro Inoue, all of Nara, Japan

[73] Assignee: Matsushita Electric Industrial Co., Ltd., Osaka, Japan

[21] Appl. No.: 27,819

[22] Filed: Mar. 19, 1987

[30] Foreign Application Priority Data

| | | | |
|---|---|---|---|
| Mar. 25, 1986 | [JP] | Japan | 61-66359 |
| May 8, 1986 | [JP] | Japan | 61-105219 |
| Jun. 20, 1986 | [JP] | Japan | 61-145169 |

[51] Int. Cl.[4] ..... F23D 3/02; F23D 3/14

[52] U.S. Cl. ..... 431/314; 431/310; 431/312; 431/302; 431/300; 431/201; 126/95; 126/96; 126/97

[58] Field of Search ..... 431/201, 309, 195, 300, 431/302, 313, 312, 314, 198, 199, 200; 126/95, 96, 97

[56] References Cited

U.S. PATENT DOCUMENTS

| | | | |
|---|---|---|---|
| 545,462 | 9/1895 | Edsall et al. | 431/309 |
| 776,231 | 11/1904 | Gateau | 431/199 |
| 1,170,606 | 2/1916 | Chadwick | 431/201 |
| 1,211,163 | 1/1917 | Johnson | 431/309 |
| 1,258,415 | 3/1918 | Jeavons et al. | 431/309 |
| 1,420,003 | 6/1922 | Wegman | 431/201 |
| 2,411,342 | 11/1946 | Sherman | 431/198 |
| 2,832,404 | 4/1958 | Thorpe | 431/201 X |
| 3,168,132 | 2/1965 | Axelsson | 431/309 |
| 4,465,457 | 8/1984 | Ishikawa et al. | 431/309 X |
| 4,525,137 | 6/1985 | Tomioka et al. | 126/96 X |

FOREIGN PATENT DOCUMENTS

| | | | |
|---|---|---|---|
| 37685 | 3/1968 | Finland | 431/201 |
| 326078 | 4/1935 | Italy | 431/197 |
| 6830 | 2/1972 | Japan | 431/201 |
| 0112919 | 9/1980 | Japan | 431/201 |
| 0087506 | 6/1982 | Japan | 431/303 |

*Primary Examiner*—Samuel Scott
*Assistant Examiner*—Carl D. Price
*Attorney, Agent, or Firm*—Wenderoth, Lind & Ponack

[57] ABSTRACT

The present invention relates to a combustion equipment to be employed for heating in domestic use or the like. The combustion equipment is provided with an air control cylinder having a closed bottom surface inwards of an inner flame cylinder, and an outer control cylinder inwards of a vaporizing portion, and accordingly, radical deterioration of the $CO/CO_2$ characteristic can be prevented. Furthermore, the air control cylinder is divided into plural stages one above the other and has a through aperture in the lowermost stage connecting said lowermost stage with an inner air path, and at the same time, the outer control cylinder is formed with through holes. Therefore, the combustion equuipment of the present invention has a large range of adjustment of the combustion volume, and is safe and comfortable in use.

9 Claims, 7 Drawing Sheets

VAPORIZING FUEL BURNER

BACKGROUND OF THE INVENTION

The present invention relates to a combustion equipment for use in domestic heating, etc.

Conventionally, for the combustion equipment of the type referred to above, a lift vaporizing type combustion equipment used in an oil stove or the like is already known, which is generally shown in FIG. 1. Referring to FIG. 1, a wick 1 is vertically movably positioned between an inner guide sleeve 2 and an outer guide sleeve 3. The respective upper end portions of the inner guide sleeve 2 and the outer guide sleeve 3 form an inner fire plate 4 and an outer fire plate 5 onto which an inner flame cylinder 6 and an outer flame cylinder 7 are respectively mounted. The tip end of the wick 1 is, when the combustion takes place, exposed in the interior of a combustion portion 8 defined between the inner and outer flame cylinders 6 and 7, whereat the fuel is vaporized. The inner flame cylinder 6, the outer flame cylinder 7 and an outer cylinder 9 are disposed in generally concentric relation with each other sequentially in this order from inside of the device and are integrally coupled by a setting pin 10. Both the inner flame cylinder 6 and the outer flame cylinder 7 have many air holes 11. An inner top plate 12 which closes an opening portion at the upper end of the inner flame cylinder 6 is formed with a top hole 13 leading into an upper portion of the inner flame cylinder from the inside of the inner flame cylinder 6. There is placed a flame deflecting plate 14 on the inner top plate 12. The outer cylinder 9 has a neck portion 15 formed at the upper end thereof. Further, there is formed a red heat portion 16 in the outer flame cylinder 7 above the neck portion 15, which portion 16 has through holes 17 each with a large mouth. The combustion equipment further includes a heat permeable cylinder 18 which is made of heat permeable material such as glass or the like and put on the outer cylinder 9. An outer top plate 19 is placed at the upper end of the red heat portion 16 in such a manner as to close the upper end of an outer air path 20 formed between the red heat portion 16 and the heat permeable cylinder 18, thereby settling the heat permeable cylinder 18. In the above-described construction, when the wick 1 is lighted to start burning, the combustion gas at high temperatures rises up in the combustion portion 8, resulting in a draft. Accordingly, the air necessary for combustion is supplied, from the air holes 11 of the inner and outer flame cylinder 6 and 7 and the through holes 17 of the red heat portion 16, into the combustion portion 8. Thus, the combustion is continued, red-heating the red heat portion 16, thereby to obtain the radiant heat.

In the prior art arrangement, however, such drawbacks as described below cannot be avoided.

As shown in FIG. 1, in a normal intense combustion, a secondary flame f1 is formed over the inner and the outer flame cylinders 6 and 7, thereby to burn completely the non-burnt components coming up through the combustion portion 8. Accordingly, the exhaust gas displays favorable characteristics. On the contrary, however, in the case where only a litte of the wick 1 is exposed and the combustion volume is small, the flame comes down into the combustion portion 8 as indicated by f2. In this case, the flame f3 formed in the air holes 11 and the through holes 17 comes not to be formed above the flame f2. In such a state as above, the characteristics of the exhaust gas, particularly, $CO/CO_2$ characteristic has been rapidly deteriorated. Moreover, in the case where the combustion device is used for a long period of time in a room which is tightly closed up, the combustion volume is gradually decreased in accordance with the decrease in density of oxygen. Therefore, if the flame falls down inside the combustion portion 8 as described above, a large quantity of carbon monoxide is generated. It was found out from the measurement of the exhaust gas in the prior art combustion equipment that the above-described phenomena result from the flow of the combustion gas and the air.

FIG. 2 shows the distribution of CO measured in the heightwise direction taken along the line A—A' (namely, in the outer air path 20 between the outer cylinder 9 or the heat permeable cylinder 18, and the outer flame cylinder 7) and the line B—B' (that is, in the inside of the inner flame cylinder 6) both at the time of strong combustion and at the time of weak combustion. At the position A—A' when the combustion is strong, the density of Co is immediately increased just above the neck portion 15 of the outer cylinder 9, and becomes the highest value at the upper middle portion thereof, and is decreased again near at the upper end portion of the outer air path 20. Nevertheless, the density of CO has a value over 500 ppm at the upper end portion of the outer air path 20. However, during the strong combustion, since the flame f1 almost completely burns the gas, the characteristic of the exhaust gas is satisfactory. During weak combustion, the contribution of the density of CO is similar to that during the strong combustion. The density of CO is about 250 ppm near the upper end of the outer air path 20 when it is burnt weakly. In this case, however, the flame f2 falls down, and accordingly CO is discharged directly into the atmosphere from the through holes 17 near the upper end of the red heat portion 18. At the position taken along the line B—B', either during strong combustion or weak combustion, the distribution of the density of CO displays a similar curve. Even when the combustion is weak, the density of CO is considerably high, namely over 1000 ppm near the upper end of the inner flame cylinder 6, which CO is directly discharged into the atmosphere.

Thus, from the above facts, the flow of the air and the combustion gas in the combustion equipment is as follows. Namely, as shown in FIG. 1, there is a main flow indicated by black arrows, and a flow indicated by broken line arrows. In other words, there is a flow (a) of the exhaust gas which is not completely burnt and running from the combustion portion 8 to the outer air path 20, and a flow (b) of the exhaust gas which is not completely burnt and leaking out from the combustion portion 8 into the interior of the inner flame cylinder 6. Therefore, if the flame falls into the combustion portion 8 as indicated by f2 when the combustion is weak, with no flame being formed thereabove, the combustion gas including CO of high density is discharged directly from the air holes 11 and the top hole 13 in the upper part of the inner flame cyliner 6, or from the through holes 17 above the red heat portion 16 into the atmosphere. Thus, such rapid deterioration of $CO/CO_2$ characteristic during weak combustion as described earlier is clearly due to the fact that the combustion gas including highly concentrated CO which has leaked into the inside of the inner flame cylinder 6 and the outer air path 20 is discharged directly into the atmosphere.

As described hereinabove, in order to prevent the deterioration of the exhaust gas characteristic in the case where the volume of combustion is reduced so as to be small, it has been conventionally carried out that the amount of air supplied from the lower parts of the inner and the outer flame cylinders 6 and 7 into the combustion portion 8 has been relatively restricted. In this case, however, it has been disadvantageous because the ignition characteristic is worsened or a yellow fire is produced in the combustion portion 8 because of the reduction in the amount of air supplied into the combustion portion 8. Furthermore, since the air for combustion is also reduced in the case where the density of oxygen in the room is reduced (the oxygen deficient state), there have been dangerous possibilities that much CO is generated. Moreover, in the prior art arrangement, if the flame finally falls down into the combustion portion, the exhaust gas characteristic is deteriorated, and therefore the prior art arrangement is not a good arrangement.

SUMMARY OF THE INVENTION

Accordingly, an essential object of the present invention is to provide a combustion equipment which substantially eliminates the disadvantages inherent in the prior art, which is arranged to improve the exhaust gas characteristic through prevention of rapid deterioration of the exhaust gas characteristic when it is burnt weakly, and at the same time which is arranged to enlarge the range of adjustment of the combustion volume, with simultaneous achievement of excellent characteristics at the time of ignition and in the oxygen deficient state, and excellent combustion condition, etc.

In accomplishing the above-described object, according to the present invention, a combustion equipment has an air control cylinder provided inwards of an inner flame cylinder and extending upwardly from the vicinity of a position opposite to a wick so as to shut the bottom surface of an air control zone defined between the inner flame cylinder and the air control cylinder, and an outer control cylinder provided above the inside of a vaporizing portion to form an outer control zone spaced a small interval from an outer flame cylinder. According to the combustion equipment having the above-described construction, the combustion gas is prevented from leaking to an inner air path inside the inner flame cylinder or to an outer air path outwardly of the outer flame cylinder, thereby to achieve effective combustion.

Moreover, the outer control cylinder is provided with through holes communicating the outer control zone with a combustion portion, while the air control cylinder is provided in plural stages with a through aperture so that the inner air path is vertically communicated with the air control zone. Accordingly, the air is supplied into the combustion portion satisfactorily, resulting in excellent ignition characteristic, combustion condition and oxygen deficiency characteristic.

BRIEF DESCRIPTION OF THE DRAWINGS

These and other objects and features of the present invention will become apparent from the following description of preferred embodiments of the invention taken in conjunction with the embodiments thereof with reference to the accompanying drawings, in which.

DETAILED DESCRIPTION OF THE INVENTION

Figure 1:
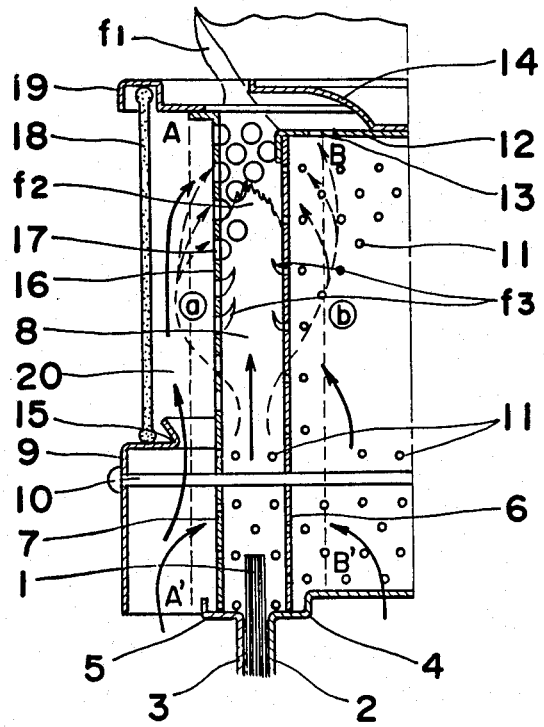
Fig. 1 PRIOR ART
FIG. 1 is a cross sectional view of an essential portion of a prior art combustion equipment.
Figure 2:
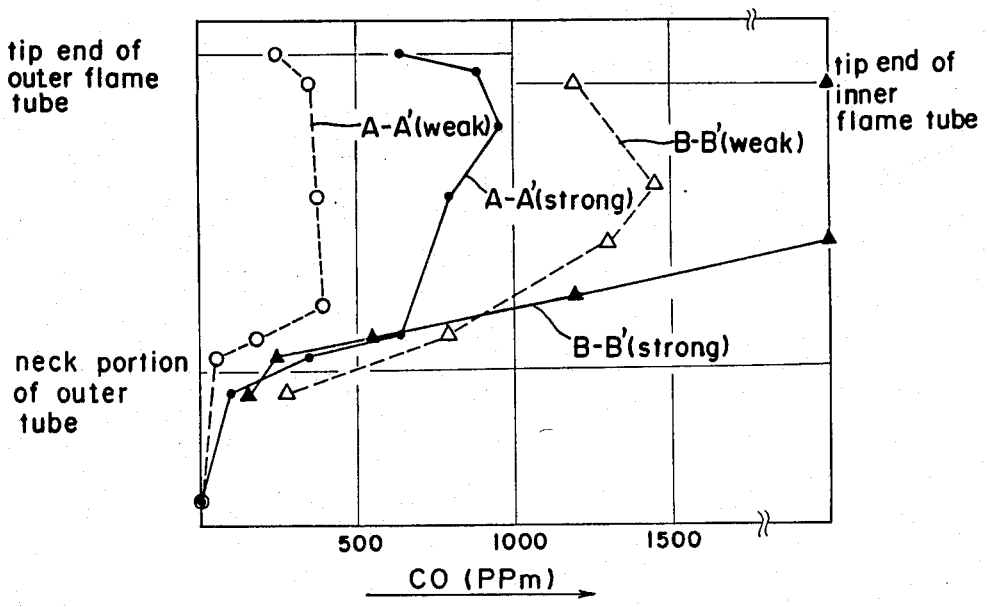
FIG. 2 is a diagram showing the distribution of CO within the combustion equipment of FIG. 1.

Before the description of the present invention proceeds, it is to be noted that like parts are designated by like reference numerals throughout the accompanying drawings.

Figure 3:
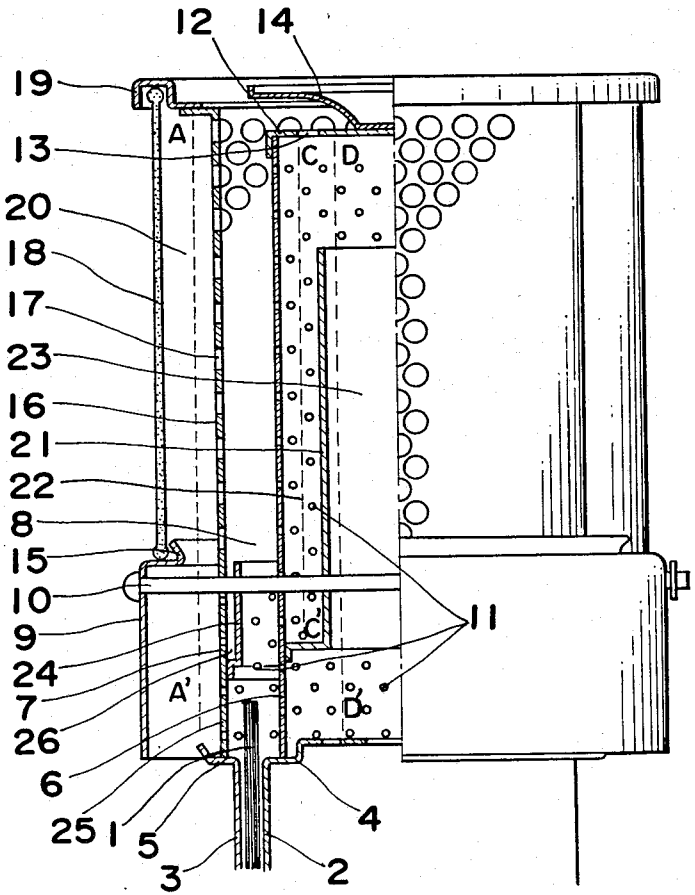
FIG. 3 is a cross sectional view of an essential portion of a combustion equipment according to a first embodiment of the present invention.

Referring to FIG. 3, a wick 1 is so set between an inner guide sleeve 2 and an outer guide sleeve 3 as to be vertically movable. The upper end portions of the inner guide sleeve 2 and the outer guide sleeve 3 are respectively formed into an inner fire plate 4 and an outer fire plate 5 onto which are placed an inner flame cylinder 6 and an outer flame cylinder 7. The tip end of the wick 1 is exposed, during burning, into the interior of a combustion portion 8 defined between the inner and outer flame cylinders 6 and 7. The fuel is vaporized in the combustion portion 8. In the combustion equipment of FIG. 3, the inner flame cylinder 6, the outer flame cylinder 7 and an outer cylinder 9 are so disposed as to be concentric with each other sequentially in this order from the inside of the device and integrally connected by a setting pin 10. There are formed many air holes 11 in the inner and outer flame cylinders 6 and 7. An inner top plate 12 closing an opening at the upper end of the inner flame cylinder 6 has a top hole 13 which is opened upwards from the inner side of the inner flame cylinder 6. On the inner top plate 12, a flame deflecting plate 14 is provided. A red heat portion 16 is formed in the outer flame cylinder 7 above a neck portion 15 of the outer cylinder 9, which has a through hole 17 with a large opening mouth. A heat permeable cylinder 18 made of a heat permeable material such as glass or the like is put on the outer cylinder 9. An outer top plate 19 is placed at the upper end of the red heat portion 16 in such a manner as to close the upper end of an outer air path 20 formed between the red heat portion 16 and the heat permeable cylinder 18, so that the heat permeable cylinder 18 is secured. An air control cylinder 21, which is secured at its lower end to the inner flame cylinder 6 and spaced inwards of the inner flame cylinder 6, extends from the vicinity of a point just above the wick 1 near to the upper end of the inner flame cylinder 6, and at the same time, the air control cylinder 21 has a lower end portion which closes the bottom of an air control zone 22 formed between the inner flame cylinder 6 and the air control cylinder 21. Within the air control cylinder 21 is an inner air path 23. Furthermore, the combustion equipment includes an outer control cylinder 24 spaced inwards of a vaporizing portion 25 below a position opposite to the neck portion 15. The outer control cylinder 24 extends from the vicinity of a point just above the wick 1 near to a position opposite the neck portion 15 of the outer cylinder 9, forming an outer control zone 26 in the form of a little gap between it and the vaporizing portion 25.

Figure 4:
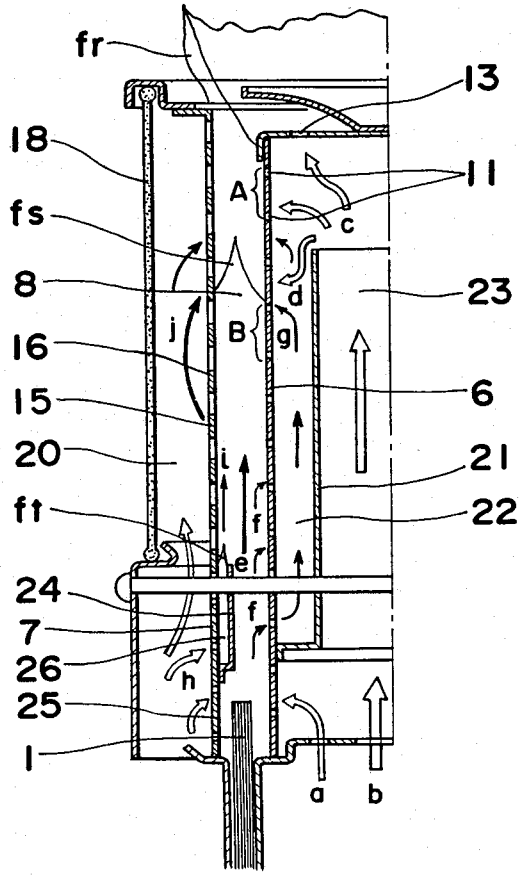
FIG. 4 is a cross sectional view showing the flow of the air and the combustion gas in the combustion equipment of FIG. 3.

In the above-described construction, when the wick 1 is lighted to start burning, the combustion gas at high temperatures rises in the combustion portion 8, thereby to bring about a draft. Consequently, the air necessary for combustion is supplied through the air holes 11 formed in the inner and outer flame cylinder 6 and 7 and also through the through holes 17 in the red heat portion 16, and the combustion is continued. When the combustion is intense, a flame fr as shown in FIG. 4 is formed. The flow of the combustion exhaust gas and the air at this time will be described hereinbelow separately, with respect to the flow inside the inner flame cylinder 6 and the flow in the outer air path 20 formed between the red heat portion 16 and the heat permeable cylinder 18. The air supplied from the inner side of the inner flame cylinder 6 is divided into two flows of air, that is, an air flow (a) which is supplied from below the air control cylinder 21 to the vicinity of the wick 1, and an air flow (b) which rises along the inner air path 23. When the air flow (b) reaches the upper part of the inner flame cylinder, it is sent, as indicated by (c) in FIG. 4, to the combustion portion 8 and thereabove through the air holes 11 and the top hole 13. A part of the air flow (b) flows down into the air control zone 22 as shown by (d) so as to be supplied to the combustion portion 8 also from the air holes 11 positioned relatively at the lower part of the inner flame cylinder 6. On the other hand, the fuel vaporized by the air flow (a) is mixed with the air to become a fuel gas which mainly rises in the combustion portion 8 as indicated by (e). However, since the pressure in the air control zone 22 is rendered negative by the air flows (c) and (d), a part of the fuel gas flows into the air control zone 22 through the air holes 11 as indicated by (f), and then rises up therein. Therefore, the air control zone 22 is filled with the non-burnt gas, that is, the gas which has not been burnt yet. The non-burnt gas rises in the air control zone 22 to be mixed with the air flows (c) and (d) in the vicinity of the upper end of the air control cylinder 21, as indicated by (g), for supply into the combustion portion 8 through the air holes 11. Accordingly, when the combustion is intense, the non-burnt gas is well mixed with the air in the vicinity of the upper end of the inner flame cylinder 6 and is supplied near the upper end portion of the combustion portion 8, and as a result of this, it is effectively burnt around the area A, whereat the flame is formed to red-heat the portion. Further, the non-burnt gas which has not been completely burnt here at the area A is burnt by the flame fr formed above the area A. Then, when the wick 1 is lowered for weak combustion, the flame gradually sinks into the combustion portion 8 to be a flame fs. The flow of the air and the combustion exhaust gas is similar in this case to that during the strong combustion, except that the amount of vaporized gas is greatly reduced. Because of this fact, the amount of the non-burnt gas flowing into the air control zone 22 is also reduced, resulting in that the position of the region where the non-burnt gas is mixed with the air (d) is lowered. Consequently, the vicinity of the aera B becomes a favorable mixing area, whereat the flame is formed to red-heat the wall surface of the inner flame cylinder 6. Thus, the combustion is promoted and, completed by the flame fs formed above the area B. Next, the flow in the outer air path 20 will be described. Since the outer control cylinder 24 is provided in the upper middle part of the vaporizing portion 25, this outer control cylinder 24 controls and restricts leakage of the combustion gas into the outer air path 20. More specifically, in the prior art which has no such control cylinder as the outer control cylinder 24, the combustion gas rises up in the combustion portion 8 while spreading in the widthwise direction of the combustion portion 8, and therefore, as soon as the combustion gas reaches the red heat portion 16, it leaks into the outer air path 20 immediately. On the contrary, according to the present embodiment, because of the presence of the outer control cylinder 24, the flow of the combustion gas up the side of the inner flame cylinder 6 is spaced inwardly by the width of the outer control zone 26. Therefore, the combustion exhaust gas coming up from the lower part of the combustion portion 8 is restrained from leaking to the outer air path 20. Moreover, a fixed amount of the air supplied from the air holes 11 of the vaporizing portion 25 confronting the outer control cylinder 24 to the outer control zone 26 as indicated by (h) is jetted out into the combustion portion 8 through an exit of the outer control zone 26 to be mixed with the vaporized gas, so that the gas is burnt here to form a flame ft. The combustion gas indicated by (i) near the inner wall of the red heat portion 16, restricts the non-burnt gas (e) which comes up from the lower part of the combustion portion 8 from leaking to the outer air path 20. The layer of combustion gas (i) climbs the vicinity of the red heat portion 16 and accordingly, the combustion gas actually and naturally leaks into the outer air path 20 as shown by (j). However, the combustion gas (j) has been considerably burnt by the flame ft formed at the exit of the outer control zone 26, includes much $CO_2$. Therefore, even when the combustion gas (j) is discharged from the outer air path 20 to the atmosphere, it does not lead to a rapid deterioration of the $CO/CO_2$ characteristic.

Figure 5:
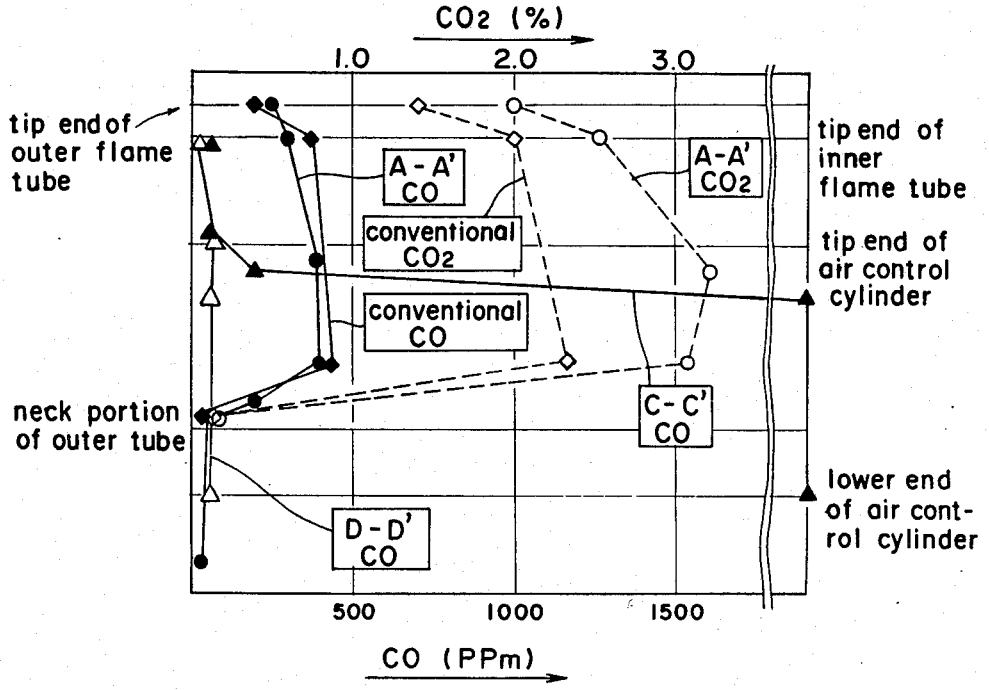
FIG. 5 is a diagram showing the distribution of CO in the combustion equipment of FIG. 3.

FIG. 5 is a diagram showing the distribution of the density of CO and $CO_2$, when the combustion is weak, measured at positions taken along the lines A—A' (the outer air path 20), C—C' (the air control zone 22) and D—D' (the inner air path 23). For comparison, the value measured at the positions taken along the line A—A' in the prior art is also indicated in FIG. 5. With respect to CO, the value at the positions along the line A—A' is approximately the same as in the prior art, while the value of $CO_2$ in the present embodiment is considerably higher than that in the prior art, which therefore coincides with the above described effect that the combustion gas, even when it is leaked to the outer air path 20, does not invite a rapid deterioration of $CO/CO_2$ characteristic. At the positions along the line C—C', although highly dense CO is observed at the lower end of the air control cylinder 21, the density of CO is gradually decreased near the upper end of the air control cylinder 21 so as to be quite thin at the upper end of the inner flame cylinder 6. It is found that the area above the inner flame cylinder 6 is clean, with CO at low density. At the positions along the line D—D' inwards of the air control cylinder 21, the density of CO is as thin as about 30 ppm all over the area. From this, it is found out that clean air is supplied there. This result also agrees with the foregoing description.

Figure 6:
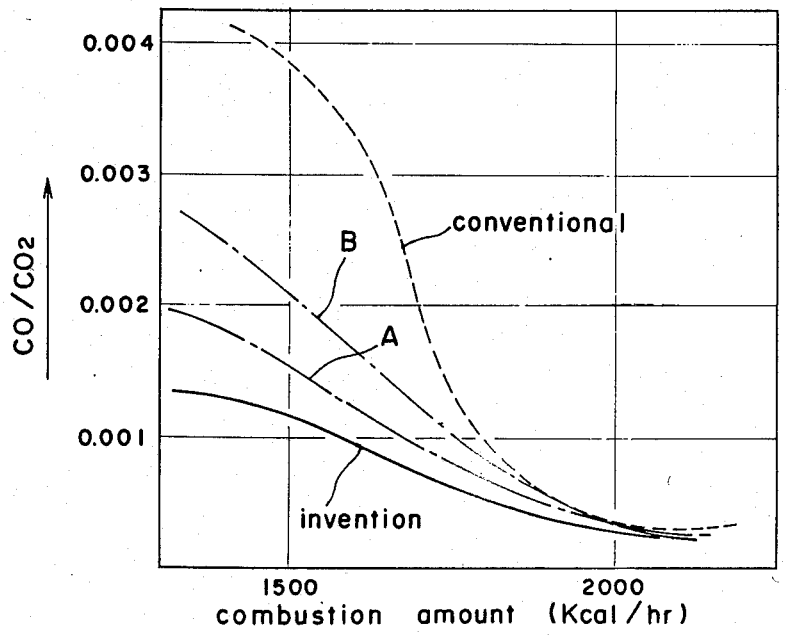
FIG. 6 is a diagram showing the $CO/CO_2$ characteristic of the combustion equipment of FIG. 3.

FIG. 6 is a diagram showing the relationship of the combustion volume with respect to the $CO/CO_2$ characteristic in the present embodiment and in the prior art. As the combustion volume is reduced in the prior art (shown by a broken line), the value of $CO/CO_2$ is raised suddenly, which means the deterioration of the exhaust gas characteristic. On the other hand, in the present embodiment, even when the combustion volume is made small, the $CO/CO_2$ displays a low value. Therefore, it is clear that the characteristics are improved largely according to the present invention. This advantageous effect of the present invention results from the installation of both the air control cylinder 21 and the outer control cylinder 24 in the combustion equipment. Although it is effective when one of the two cylinders 21 and 24 is installed, such a great effect as described above cannot be expected. For the sake of reference, the $CO/CO_2$ characteristic in the case of (A) where only the air control cylinder 21 is installed and in the case of (B) where only the outer control cyliner 24 is formed is respectively represented in FIG. 6. The advantage of the present invention is clearly seen from FIG. 6.

As is described above, the $CO/CO_2$ characteristic is greatly improved by the arrangement of the embodiment shown in FIG. 3. As is understood from FIG. 3, however, since the supply of the air to the lower part of the combustion portion 8 is limited in the arrangement of FIG. 3 as it is, the consequential lack of air tends to worsen the ignition characteristic and the exhaust gas characteristic. Moreover, a yellow fire is likely to leak into the combustion portion 8, and accordingly, it is difficult to obtain a good combustion condition in the arrangement of FIG. 3 as it is. These inconveniences can be improved in a manner as will be described hereinbelow. The prior art combustion device fundamentally has a tendency that the exhaust gas characteristic gets worse, and therefore, it was impossible according to the prior art that both the ignition characteristic and the exhaust gas characteristic be satisfied simultaneously. However, by the following technique, improvements in such characteristics as the exhaust gas characteristic, the ignition characteristic, the oxygen deficiency characteristic and the combustion condition, etc. can be met simultaneously at one time, with the advantage of the present invention being enjoyed fully to its utmost.

Figure 8:
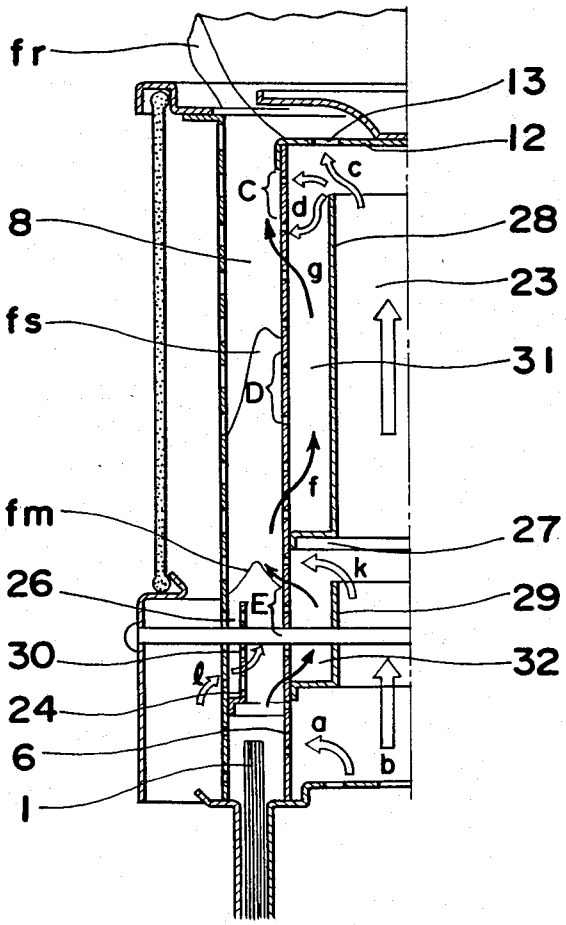
FIG. 8 is a cross sectional view of the flow of the air and the combustion gas in the combustion equipment of FIG. 7.
Figure 7:
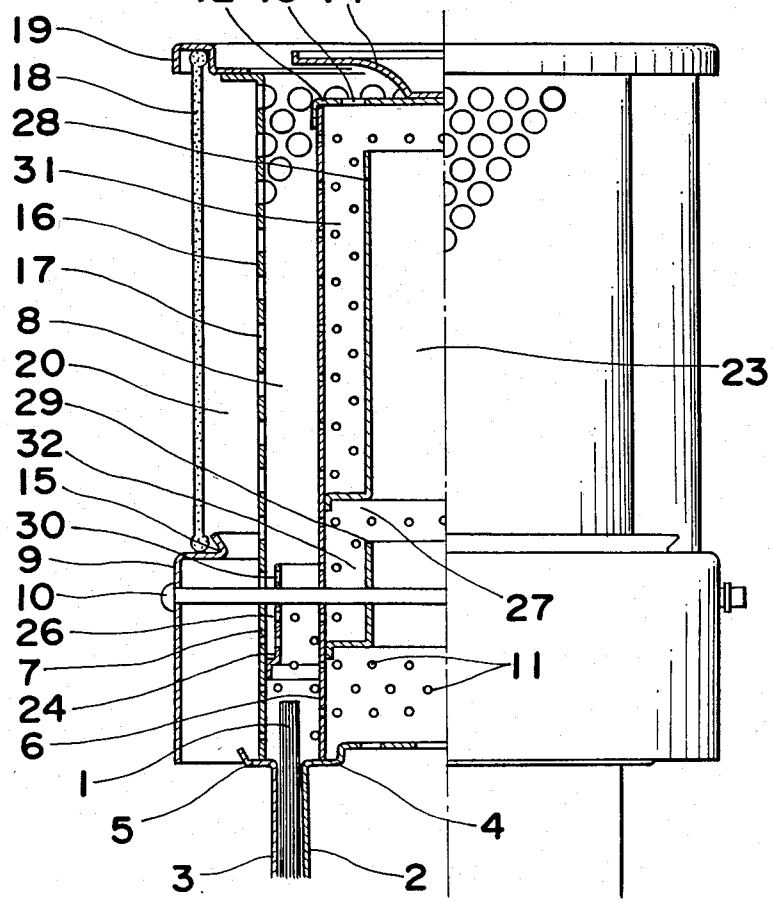
FIG. 7 is a cross sectional view of an essential portion of a combustion equipment according to a second embodiment of the present invention.
Figure 9:
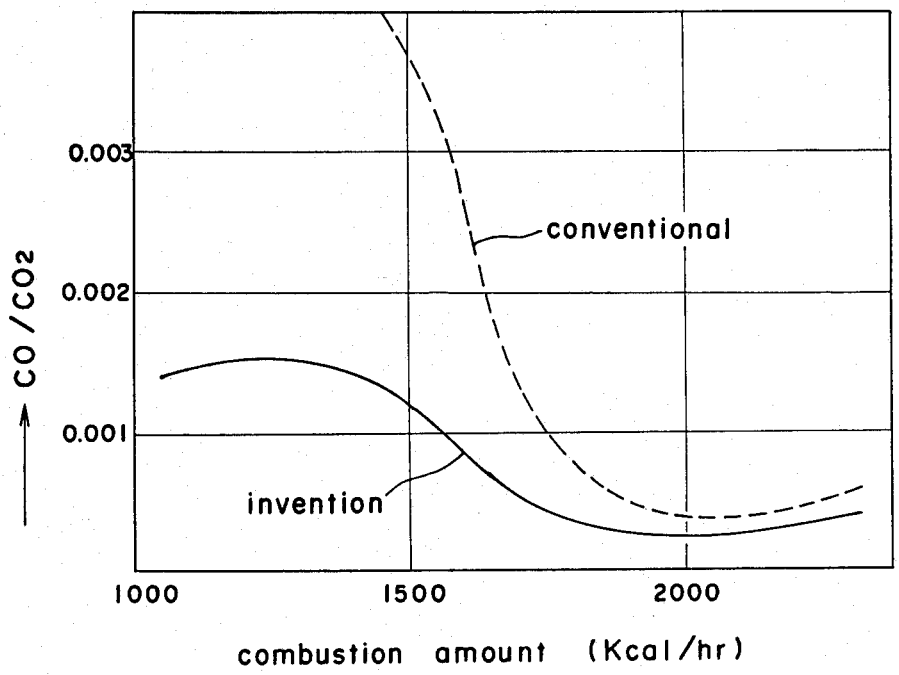
FIG. 9 is a diagram showing the $CO/CO_2$ characteristic of the combustion equipment of FIG. 7.

FIG. 7 shows a cross sectional view of an essential portion of a combustion equipment according to the second embodiment of the present invention, which aims to overcome the deficiencies in the first embodiment. An air control cylinder is divided into upper and lower stages, i.e., an upper control cylinder 28 and a lower control cylinder 29, thereby to form a through aperture 27 communicating with the combustion portion 8. Further, the outer control cylinder 24 has many through holes 30 formed in the wall surface thereof, such that the outer control zone 26 is communicated with the combustion portion 8 through the through holes 30. There are an upper control zone 31 and a lower control zone 32. Referring to FIG. 8 showing a cross section of the flow within the combustion device of FIG. 7, the air flow (k) from the through aperture 27 and the air flow (l) from the through holes 30 send the air positively to the lower part of the combustion portion 8. When the combustion is continued in this construction, the operation of the combustion device is approximately the same as in the aforementioned first embodiment during the strong combustion. When the wick 1 is lowered to be less exposed, and the combustion volume is decreased, the flame gradually falls down in the combustion portion 8 to be a flame fs. In this case, the flow of the air runs similarly to the case where it is burnt strongly. However, the amount of vaporized gas is greatly reduced, and the non-burnt gas flowing into the upper control zone 31 is accordingly reduced. Therefore, the mixture zone where the non-burnt gas is mixed with the air flow (d) is lowered. The area D and thereabout are good mixture areas, whereat the flame is formed to red heat the wall surface of the inner flame cylinder 6. The combustion is completed by the flame fs formed in the inner part of the inner flame cylinder 6. In this case, the flow (f) of the non-burnt gas flowing into the upper control zone 31 is supplied mostly into the combustion portion 8 by the air flows (c) and (d) to be burnt by the flame fs. As a result, almost no components of the non-burnt gas are present in the upper control zone of the outer control cylinder 24 above the flame fs, and the air discharged through the air holes 11 and the top hole 13 above the flame fs is clean, without deteriorating the exhaust gas characteristic ($CO/CO_2$). The density of CO is approximately 30–50 ppm near the through aperture 27, which tends to be increased a little as compared with the case in the first embodiment, but never causes the $CO/CO_2$ characteristic to deteriorate. Meanwhile, when the flame is further lowered, the temperatures in the upper part of the inner flame cylinder 6 are reduced. In consequence, even though the air is sufficiently supplied into the upper control zone 20 by the air flow (d), the combustion is not promoted. Therefore, the air discharged from the above flame fs comes to include many CO components step by step, resulting in gradual deterioration of the exhaust gas characteristic. However, if the combustion volume is still further reduced and the flame is formed at fm below the lower end of the upper control cylinder 28, the temperatures near the flame fm are high and moreover, sufficient amount of air is supplied by the air flow (k) from the through aperture 27, and accordingly, the combustion is promoted around the area E. Although the exhaust gas flows to the upper control zone 31 in this case, this exhaust gas has been burnt to advanced degrees by the flame fs. Therefore, the ratio of CO with respect to the exhaust gas components is not very high. Thus, the exhaust gas characteristic is not worsened. FIG. 9 is a diagram showing the $CO/CO_2$ characteristic of the combustion device of the second embodiment. It is seen from FIG. 9 that even in the case where the combustion volume is reduced, the second embodiment provides favorable characteristics without rapid deterioration in the $CO/CO_2$ characteristic.

Figure 10:
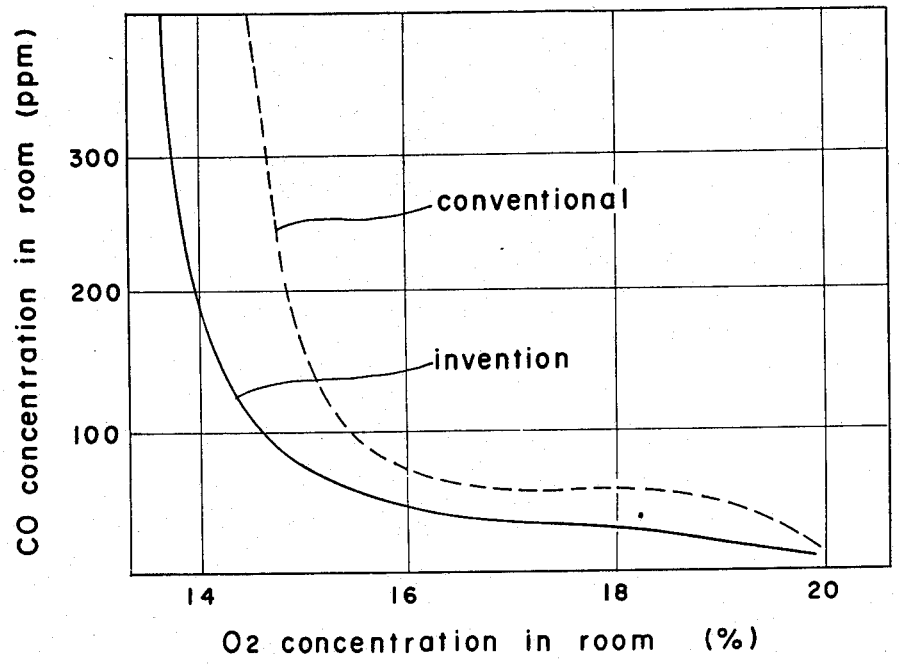
FIG. 10 is a diagram showing the oxygen deficiency characteristic of the combustion equipment of FIG. 7.

Although there has been described above the case where the wick 1 is lowered so as to be less exposed to decrease the combustion volume in normal combustion, the same effect is as accomplished in the above-described embodiments can be obtained also in the case where the equipment is operated for a long period of time in a tightly sealed room. In other words, in an oxygen deficient state, the combustion volume is reduced in accordance with the decrease in the density of oxygen, which is approximately the same phenomenon as in the case where the wick 1 is lowered to reduce the combustion volume. However, since the air is supplied from the through aperture 27 and the through holes 30, a lack of the air hardly occurs, and the oxygen deficiency characteristic will be good. FIG. 10 is a diagram showing the oxygen deficiency characteristic of the combustion equipment of FIG. 7. According to the combustion equipment of the second embodiment, in comparison with the prior art, the amount of CO generated is smaller even in the low oxygen region. Moreover, the air is arranged to be positively supplied to the lower part of the combustion portion 8, and accordingly, a good combustion condition can be gained with less possibilities for the yellow fire to be mingled. Additionally, since the air is sufficiently supplied also at the time of ignition, the combustion is effected speedily, with simultaneous restriction of generation of bad odor and CO.

The control cylinder is in two stages in the above-described embodiment for the sake of convenience of explanation thereof, but may be formed in more than three stages.

Figure 12:
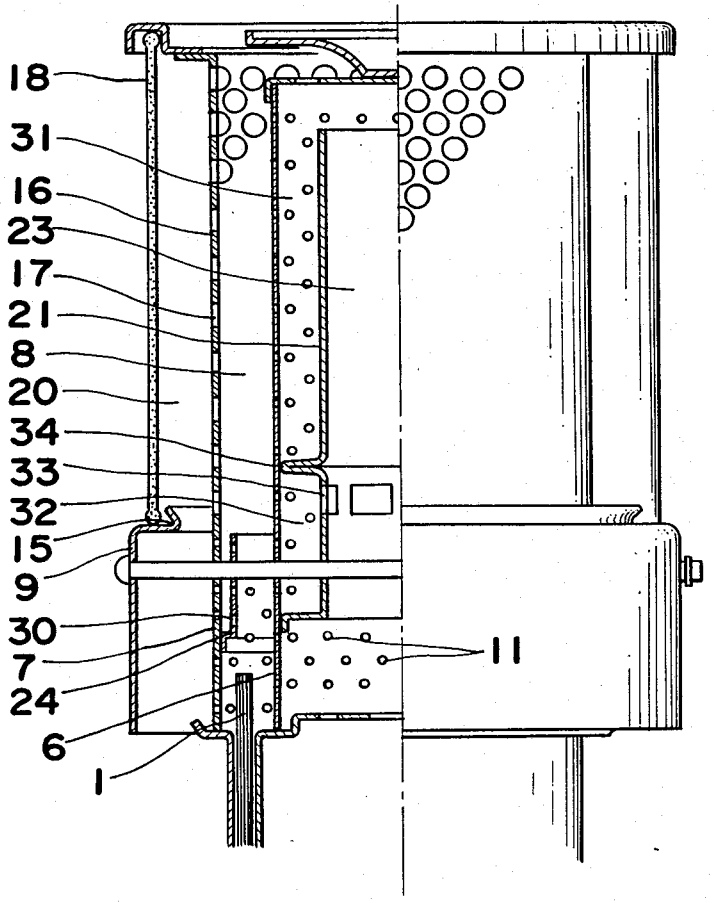
FIGS. 11 through 14 are cross sectional views of an essential portion of a combustion equipment according to different embodiments of the present invention.
Figure 11:
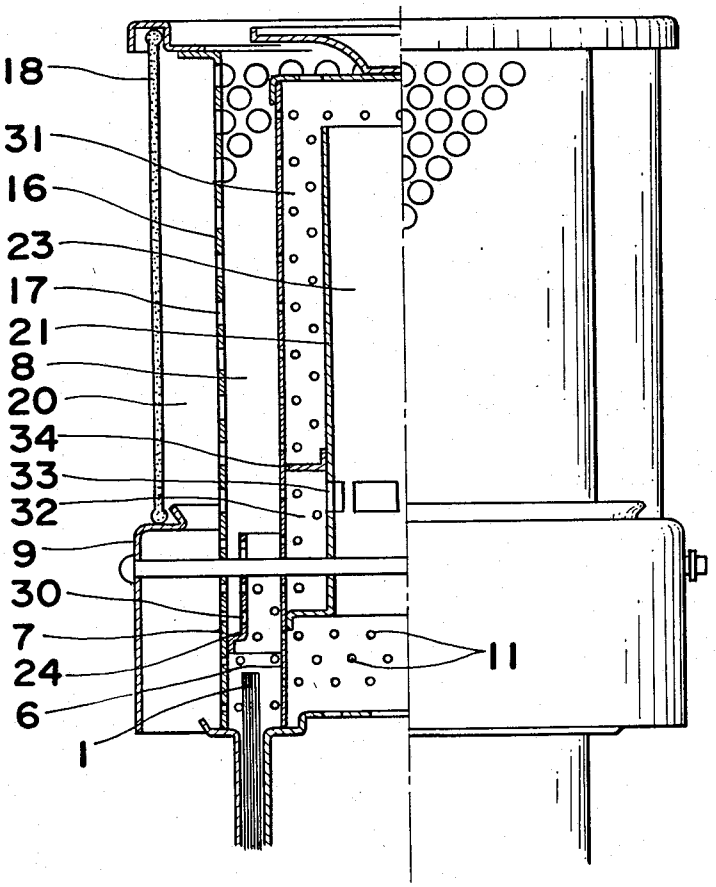
Figure 14:
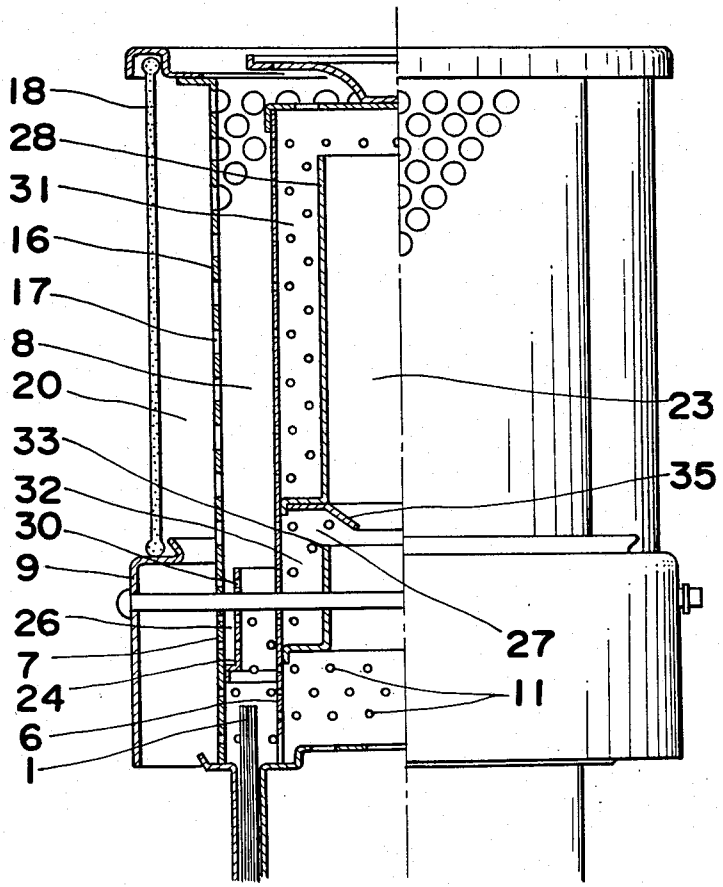
Figure 13:
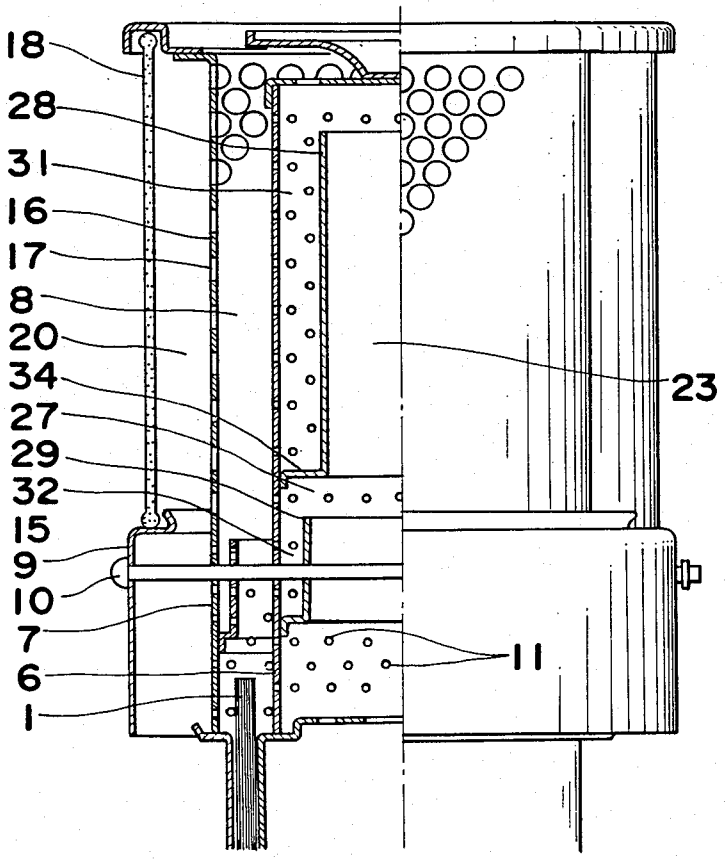

For example, in FIGS. 11 and 12, there is shown a combustion equipment having an air control cylinder with plural stages according to other embodiments of the present invention. Referring to FIG. 11, the combustion equipment has the air control cylinder 21 which is provided with through apertures 33 in the lateral side surface thereof. The air control zone is divided into an upper and a lower portion 31 and 32 right above the through aperture 33, and a separate plate 34 is provided so as to divide the air control zone. According to the above-described construction, there is no need to install a plurality of air control cylinders. Moreover, it is advantageous from the manufacturing viewpoint that the air control cylinder having two stages is able to be formed integrally. Referring to the combustion device of FIG. 12, the air control cylinder 21 is crimped radially outwardly thereof, thereby to form the separate plate 34. Therefore, no welding operation is necessary at all, such both the air control cylinder 21 and the separate plate 34 can be formed as an integral body, enhancing the structure. Needless to say, it is possible to provide the air control cylinder in plural stages also in this case. FIG. 13 shows the construction of means by which the ignition characteristic is improved more than the second embodiment of FIG. 7. The upper part of the air control, that is, the upper control cylinder 28 has a smaller diameter than the lower control cylinder 29, and the separate plate 34 of the upper control cylinder 28 serves for guiding the air to be supplied from the through aperture 27 to the combustion portion 8, thereby to achieve the effective supply of the air and the reduction in generation of CO and bad odor at the time of ignition. Further, as shown in FIG. 14, if the upper control cylinder 28 is provided at the lower end thereof with an air guide plate 35 which protrudes downwardly from the inner side of the cylinder 28, the same effect as above can be achieved. It goes without saying that the arrangement shown in FIG. 11 or FIG. 12 can be employed also in this case.

The present invention has been described hereinabove with respect to the various embodiments thereof, the advantageous effects of which will be summarized now item by item.

(1) The clean air in the inner air path and the combustion gas introduced into the air control zone can be separated from each other by the air control cylinder, so that clean air is able to be supplied towards the upper part of the inner flame cylinder, thereby to improve the $CO/CO_2$ characteristic.

(2) Since the combustion gas and the air are mixed in a proper condition at the level in the inner flame cylinder in accordance with the combustion volume in the neighborhood of the upper end of the air control cylinder, the combustion is accelerated, thereby to achieve reduction of the $CO/CO_2$ characteristic, with no leakage of the combustion gas including highly dense CO.

(3) When the combustion volume is further decreased and the flame is further lowered, the temperatures above the flame drop even though sufficient air is supplied into the air control cylinder. As a result, the combustion is not promoted enough, and the amount of CO is gradually increased in the combustion gas. Therefore, the $CO/CO_2$ characteristic tends to be gradually worsened. However, since the air control cylinder is formed in plural stages, the combustion progresses again due to the air supplied from the through aperture immediately below the upper control cylinder when the flame comes down lower than the upper control cylinder. Consequently, the exhaust gas flowing into the upper air control zone is considerably burnt and becomes low in CO ratio. Therefore, even if this exhaust gas is discharged, it does not bring about the deterioration of the combustion characteristics.

(4) The flow of the clean air supplied from the inner air path to the upper part of the inner flame cylinder cuts off the flow of the combustion gas upwards in the inner flame cylinder. Owing to this fact, almost no combustion gas in included inside the upper part of the inner flame cylinder. Accordingly, even when the flame sinks into the combustion portion during the weak combustion, there is no possibility that CO at high density is discharged directly into the atmosphere. Therefore, the reduction of $CO/CO_2$ can be accomplished.

(5) Since the combustion burden in the combustion portion is lessened by the outer control cylinder, the flame is prevented from falling into the combustion portion when it is burnt weakly, and the combustion gas is restricted from being discharged from the outer air path to the atmosphere through the upper part of the red heat portion, thereby to reduce $CO/CO_2$.

(6) Owing to the effects of air control by the outer control cylinder, the combustion gas rising up the lowest part of the combustion portion is restricted from leaking to the outer air path. Therefore, the deterioration of the $CO/CO_2$ characteristic can be controlled.

(7) The combustion is promoted in the vicinity of the inner wall of the read heat portion by the air jetted out of the outer control zone to the combustion portion, thereby forming a layer of the combustion gas including much $CO_2$. Accordingly, the non-burnt gas rising from the lower part of the combustion portion is prevented from leaking into the outer air path, and thus the $CO/CO_2$ characteristic is controlled so as not to deteriorate.

(8) The exhaust gas layer formed in the vicinity of the inner wall of the red heat portion includes much $CO_2$, and therefore, even if the exhaust gas is sent out to the atmosphere from the upper part of the red heat portion through the outer pair path, the $CO/CO_2$ characteristic is not deteriorated so abruptly.

(9) The mixing of the combustion gas with air supplied to the combustion portion from the through holes and the through aperture is carried out in a favorable condition to promote the combustion, thereby to control the intrusion of a yellow fire into the combustion portion, resulting in a good combustion condition.

(10) Since the air is positively supplied to the combustion portion through the through holes and the through aperture, the combustion portion does not lack air therein, and the ignition characteristic and the oxygen deficiency characteristic can be also properly maintained.

As is clear from the aformentioned effects of the present invention, the exhaust gas characteristic can be prevented from being radically deteriorated when the combustion is weak or in the oxygen deficient condition, and at the same time, the ignition characteristic is improved. Therefore, the present invention can provide a combustion equipment which has an excellent combustion characteristic, has a large range of adjustment of the combustion volume, and is safe and comfortable in use.

Although the above description is mainly directed to the combustion equipment in which liquid fuel is drawn up by a wick to be burnt, the present invention may be provided in a combustion equipment in which liquid fuel is burnt by other vaporizing means or atomizing means. Moreover, the present invention is applicable to a combustion equipment using a gaseous fuel.

As is clear from the above, the combustion equipment of the present invention has a large range of adjustment of the combustion volume, and is safe and comfortable in use as a domestic heater, and is therefore utilizable as a heating apparatus with less energy consumption and adaptable to the size of a room, whether it is large or small.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as bein included therein.

What is claimed is:

1. A combustion apparatus for buring a vaporizable fuel by mixing said fuel with air, which comprises:

a vertically oriented outer flame cylinder having a lower vaporizing portion, which lower vaporizing portion has a first plurality of through holes therein and an upper red heat portion above said vaporizing portion, said upper red heat portion having a second plurality of through holes therein, said second plurality of through holes having a size larger than the size of said first plurality of through holes in said lower vaporizing portion;

a vertically oriented inner flame cylinder within and spaced inwardly of said outer flame cylinder, said inner flame cylinder having a plurality of holes therein, said inner flame cylinder defining with said outer flame cylinder a vertically extending annular combustion space;

an outer cylinder around and spaced outwards of said outer flame cylinder;

a wick vertically movably mounted in the lower end of said combustion space for movement between a minimum height and a maximum height for adjusting the amount of combustion in said apparatus in accordance with the height of said wick, and a fuel source arranged for supplying vaporizable fuel to said wick;

an outer control cylinder positioned inward of said outer flame cylinder, said outer control cylinder extending from a position above the maximum height of said wick to the upper end of said vaporizing portion of spaced radially inwardly from said outer flame cylinder for forming an outer control zone between said outer control cylinder and said outer flame cylinder which is directed upwardly along the inside of said outer flame cylinder, said outer control cylinder having a bottom closure member thereon by which said outer control cylinder is mounted on said outer flame cylinder; and an air control cylinder positioned inward of said inner flame cylinder, said air control cylinder extending upwardly from a position above the maximum height of said wick and terminating at a position adjacent to an upper portion of said inner flame cylinder, said air control cylinder spaced from said inner flame cylinder to define a vertically extending annular air control zone between said air control cylinder and said inner flame cylinder; and means closing the bottom of said air control zone, said air control cylinder defining a vertically extending inner air path therewithin.

2. A combustion apparatus as claimed in claim 1 in which said outer control cylinder has a plurality of through holes therein which communicate said outer control zone with said combustion space.

3. A combustion apparatus as claimed in claim 1 further comprising means between said inner flame cylinder and said air control cylinder for dividing said air control zone into plural stages one above the other and the lowermost stage having a through aperture opening into said inner air path for communicating said inner air path with said lowermost stage of said air control zone.

4. A combustion apparatus as claimed in claim 3 in which said through aperture is in said air control cylinder and said means for dividing is a plate immediately above said aperture, said plate extending between said air control cylinder and said inner flame cylinder.

5. A combustion apparatus as claimed in claim 4 in which said plate is a radially outwardly extending crimp in the wall of said air control cylinder.

6. A combustion apparatus as claimed in claim 3 in which said air control zone is divided into an upper portion and a lower portion and said air control cylinder has an upper portion defining the upper portion of said air control zone, said upper portion of said air control zone being smaller in diameter than a lower portion defining the lower portion of said air control zone.

7. A combustion apparatus as claimed in claim 3 in which said air control zone is divided into an upper portion and a lower portion, and said upper portion has an air guide plate at the lower end of said upper portion, said air guide plate projecting inwardly and downwardly into said inner air path.

8. A combustion apparatus as claimed in claim 1 in which said air control cylinder has a through aperture therein opening into said inner air path for communicating said inner air path with said air control zone, and a plate immediately above said aperture, said plate extending between said air control cylinder and said inner flame cylinder for dividing said air control zone into an upper and a lower portion, the lower portion being in communication with said inner air path.

9. A combustion apparatus as claimed in claim 1 further comprising a top plate on the top end of inner flame cylinder, the upper end of said air control cylinder terminating short of said top plate to define an annular gap between said top plate and the upper end of said air control cylinder.

* * * * *